US008448397B2

(12) United States Patent
Tincher et al.

(10) Patent No.: US 8,448,397 B2
(45) Date of Patent: May 28, 2013

(54) ANCHOR SYSTEM FOR SECURING A CONCRETE WALL PANEL TO A SUPPORTING CONCRETE FOUNDATION

(75) Inventors: Terry J. Tincher, Oregonia, OH (US); Robert P. Foley, Dayton, OH (US)

(73) Assignee: Connect-EZ, LLC, Dayton, OH (US)

( * ) Notice: Subject to any disclaimer, the term of this patent is extended or adjusted under 35 U.S.C. 154(b) by 0 days.

(21) Appl. No.: 13/136,414

(22) Filed: Aug. 1, 2011

(65) Prior Publication Data

US 2013/0031857 A1 Feb. 7, 2013

(51) Int. Cl.
*E02D 27/00* (2006.01)

(52) U.S. Cl.
USPC ..... 52/293.3; 52/295; 52/432; 52/704; 249/91; 249/83

(58) Field of Classification Search
USPC ..... 52/293.3, 293.1, 295, 704, 701, 708, 52/432, 659, 125.5, 414, 707, 699, 250, 274, 52/285.2, 705; 249/83, 91
See application file for complete search history.

(56) References Cited

U.S. PATENT DOCUMENTS

| | | | | |
|---|---|---|---|---|
| 3,902,399 | A * | 9/1975 | Yotti | 411/414 |
| 3,937,119 | A * | 2/1976 | Ernst | 411/422 |
| 4,439,077 | A * | 3/1984 | Godsted | 411/411 |
| 4,665,672 | A * | 5/1987 | Commins et al. | 52/295 |
| 5,467,570 | A * | 11/1995 | Leek | 52/712 |
| 5,609,005 | A | 3/1997 | Schierloh et al. | |
| 7,070,376 | B1 * | 7/2006 | Toback | 411/82.2 |
| 7,743,580 | B2 * | 6/2010 | DeLoach, Sr. | 52/708 |
| D623,768 | S * | 9/2010 | Antonic | D25/121 |
| 2004/0040236 | A1 * | 3/2004 | Adams | 52/293.3 |
| 2007/0028552 | A1 * | 2/2007 | DeLoach, Sr. | 52/677 |
| 2007/0107338 | A1 * | 5/2007 | Daudet | 52/293.3 |

FOREIGN PATENT DOCUMENTS

GB 2466347 A * 6/2010

* cited by examiner

*Primary Examiner* — Robert Canfield
*Assistant Examiner* — Babajide Demuren
(74) *Attorney, Agent, or Firm* — Jacox, Meckstroth & Jenkins

(57) ABSTRACT

A cast concrete wall panel is secured to a concrete foundation by an anchor system which includes a steel base plate embedded adjacent the bottom surface of the wall panel and welded to a tapered channel projecting upwardly adjacent the inner surface of the wall panel to define a cavity. Reinforcing bars have bottom ends welded to the base plate and project upwardly into the concrete wall panel, and a hole is formed in the base plate at the bottom of the cavity. The hole receives a self-tapping concrete anchor bolt which is driven into a hole drilled within the foundation at an acute angle less than twelve degrees and preferably about six degrees from vertical. The channel has a removable cap to prevent concrete from entering the cavity during casting of the wall panel and to provide a decorative inside cover for the cavity after installing the anchor bolt.

16 Claims, 2 Drawing Sheets

ANCHOR SYSTEM FOR SECURING A CONCRETE WALL PANEL TO A SUPPORTING CONCRETE FOUNDATION

BACKGROUND OF THE INVENTION

The present invention relates to a connector or anchor for connecting a cast concrete wall panel to a poured concrete foundation, for example, as disclosed in U.S. Pat. No. 5,609,005, the disclosure of which is herein incorporated by reference. In this patent, a connector includes an inverted V-shaped angle member having an inclined surface supporting an inclined tubular member which extends to the outer surface of the wall panel. An anchor rod is inserted through a hole within the angle member and into an inclined hole drilled within the concrete foundation. The anchor rod is secured within the concrete foundation with an epoxy adhesive, and a nut is threaded onto the upper end portion of the anchor rod after the adhesive is cured. Commonly, each concrete wall panel is cast horizontally on a poured concrete floor after the concrete floor cures, and the cured wall panel is tilted upwardly to a vertical position and located where the anchor rods are inserted into the drilled holes within the concrete foundation. After the epoxy cures and the nut is threaded onto the upper end portion of the rod, the tubular member is commonly filled with grout, and earth may be filled in outside the wall panel to cover the grout on each connector.

It has been found desirable to connect the cast concrete wall panels to the supporting foundation with a connector or anchor system which permits anchoring the vertical wall panel to the foundation from the inside surface of the wall panel and working from the concrete floor which has been poured onto the foundation. Locating the anchor system for access from the inside surface of the wall panel also provides for convenient access to the anchor system from the concrete floor and for faster and safer installation as well as for convenient inspection of the anchor system. Inside installation of the anchor system also avoids exposure of the anchor system to corrosion from exterior weather conditions and eliminates exterior patching of the anchor system with mortar to limit weather exposure.

GENERAL DESCRIPTION OF THE PREFERRED EMBODIMENTS

The present invention is directed to an improved anchor system for securing a cast concrete wall panel to a supporting concrete foundation and which provides all of the desirable features and advantages mentioned above. In general, an anchor system constructed in accordance with the present invention includes a steel base plate which is positioned adjacent the bottom surface of the wall panel before the wall panel is cast, and a plurality of concrete reinforcing rods have lower ends welded to the base plate and project upwardly within the wall panel. A cavity forming member or tapered channel member has a lower end surface welded to the base plate and projects upwardly in flush relation with the inner surface of the wall panel. The channel member projects upwardly substantially above the floor surface and is slightly inclined on an acute angle less than twelve degrees and preferably about six degrees with respect to a vertical plane or the inner surface of the erected wall panel.

After the wall panel is lifted or tilted and erected to a vertical position and located outboard of the concrete floor, a hole is drilled into the concrete foundation on the acute angle and in alignment with a hole formed within the base plate at the bottom of the cavity defined by the channel member. A special self-tapping concrete anchor bolt is then extended through the hole in the base plate and threaded into the slightly inclined hole within the concrete foundation. The channel member provides for convenient access and alignment for drilling the inclined hole within the concrete foundation and for inserting the self-tapping concrete anchor bolt with a hand supported power operated impacting bolt driver. The base plate of the anchor system may be tilted by the slightly acute angle or the base plate may be horizontal and have an inclined spot face around the hole within the base plate at the acute angle.

Other features and advantages of the invention will be apparent from the following description, the accompanying drawings and the appended claims.

DESCRIPTION OF THE ILLUSTRATED EMBODIMENT

Figure 1:
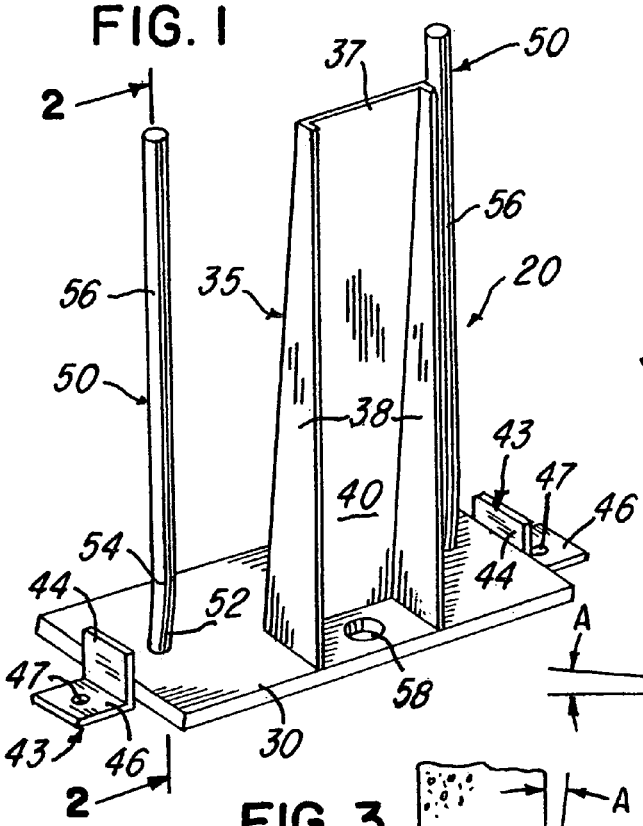
FIG. 1 is a perspective view of a wall panel anchor constructed in accordance with the invention.
Figure 2:
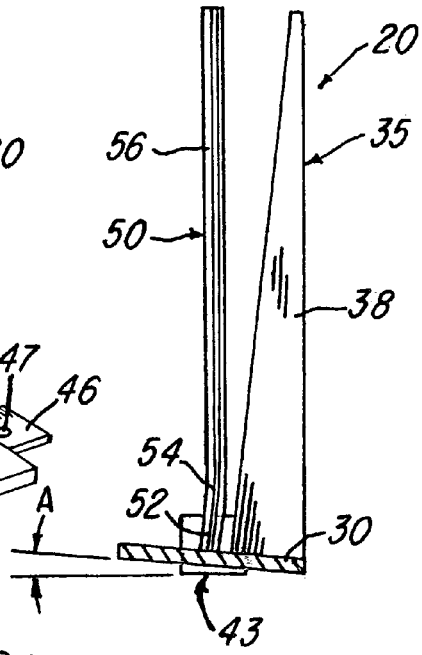
FIG. 2 is a vertical section of the anchor taken generally on the line 2-2 of FIG. 1.
Figure 3:
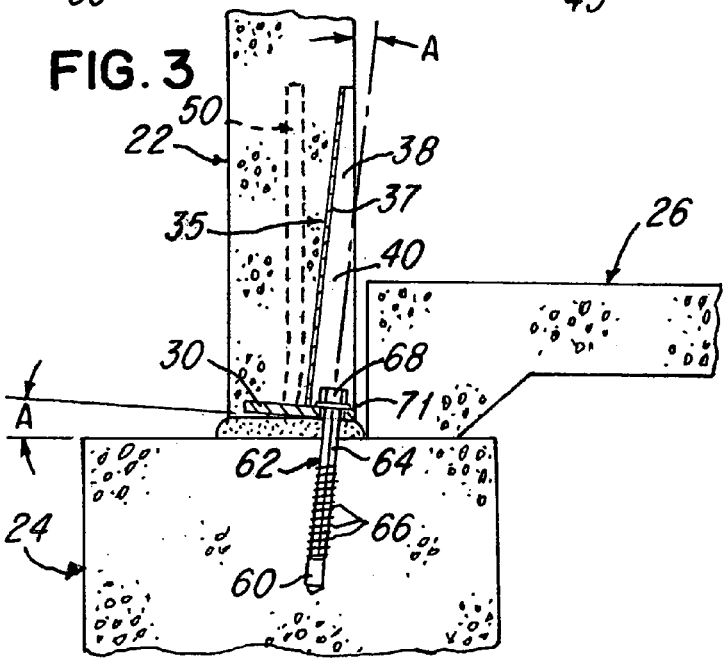
FIG. 3 is a vertical section of a concrete wall panel, concrete foundation and concrete floor showing the anchor system with the anchor of FIGS. 1 & 2 installed for connecting the concrete wall panel to the concrete foundation in accordance with the invention.

FIG. 1 illustrates a fabricated steel wall panel anchor 20 which is constructed in accordance with the invention and used for securing a cast concrete wall panel 22 (FIG. 3) to a poured concrete footer or foundation 24 which may support a poured concrete floor 26. The wall anchor 20 includes a flat steel base plate 30 having a length of about 13 inches, a width of about 6 inches and a thickness of ¾ inch. An elongated cavity defining member or tapered channel member 35 has an inner inclined wall 37 integrally connecting generally triangular opposite side walls 38. The bottom ends of the walls 37 and 38 are welded to the base plate 30 so that the member 35 forms a tapering cavity 40. The inner wall 37 of the cavity defining member or channel 35 is perpendicular to the base plate 30 which, as shown in FIGS. 2 and 3 extends at an acute angle A less than twelve degrees and preferably about six degrees. A pair of right angle brackets 43 have vertical flanges 44 welded to the ends of the slightly inclined base plate 30 and include base flanges 46 which also extend at the acute angle A with respect to the bottom surface of the base plate 30. The base flanges 46 have center holes 47.

A set or pair of steel concrete reinforcing rods or rebars or bars 50 project upwardly from the base plate 30 on opposite sides of the cavity defining member 35 and have lower end portions 52 perpendicular to the base plate 30 and welded to the base plate. The reinforcing bars 50 have a slightly curved portion or bend 54 above the lower end portions 52 so that each bar 50 has an upper portion 56 which extends vertically within the wall panel 22. The base plate 30 has a circular hole 58 of about 15/16 inch diameter within the bottom of the cavity 40.

In a conventional manner, the wall panel 22 is cast in a horizontal position, for example, as disclosed in above-mentioned U.S. Pat. No. 5,609,005. When the forms for the edges of the wall panel are placed on the floor 26, the wall anchor members 20 are attached to a form, for example, by nails or fasteners extending through the holes 47 within the brackets 43. Each anchor 20 is positioned within the forms with the edge surfaces of the side flanges 38 of the channel 35 generally flush with the top surface of the edge forms so that the edges of the side flanges 38 will be generally flush with the inner surface of the wall panel after it has poured.

After the concrete in the wall panel 22 cures, the panel is lifted or tilted to a vertical position and positioned at the desired location on the foundation 24, as shown in FIG. 3. An inclined hole 60 is drilled within the concrete foundation 24 with a concrete drill having an axis inclined on the angle A. The wall panel 22 is then secured or anchored to the foundation 24, preferably, by a self-tapping steel anchor bolt 62 which has a shank portion 64 having a sharp helical thread 66 that penetrates the concrete in the foundation 24. The shank portion 64 is integrally connected to an enlarged hexagonal head portion 68 having an outwardly projecting integral flange 71 larger than the hole 58 within the base plate 30.

One company that makes a suitable bolt 62 is Simpson Strong-Tie Company, Inc. who produces a ten inch long bolt having a ¾ inch shank diameter and sold under the trademark SIMPSON Strong-Tie. The bolt 62 is threaded into the hole 60 by a power operated impacting socket wrench supported by an operator standing on the floor 26. After the bolt 62 is tightened, it is capable of withstanding a substantial tension force, for example, 10,000 pounds. It is also apparent from FIG. 3 that when the wall panel 22 is positioned on the foundation 24, the cavity 40 is open to the inside surface of the wall panel above the top surface of the floor 26.

Figure 4:
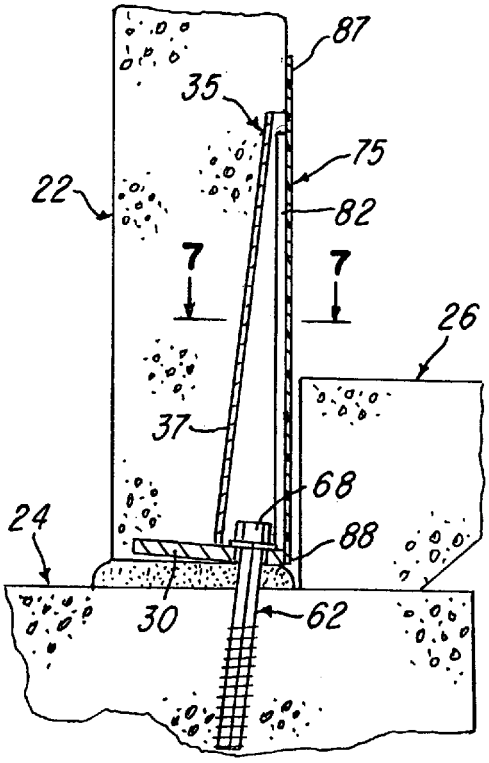
FIG. 4 is another vertical section similar to FIG. 3 and illustrating the attachment of a removable cap member onto a tapered channel member of the anchor shown in FIG. 1.
Figure 5:
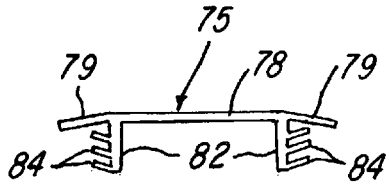
FIG. 5 is a top end view of the cap member.
Figure 7:
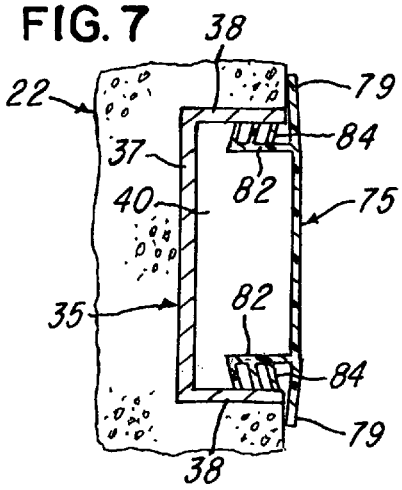
FIG. 7 is an enlarged horizontal section of the installed cap member, taken generally on the line 7-7 of FIG. 4.

To prevent concrete from entering the cavity 40 when the wall panel 22 is being cast horizontally, a removable cap member 75 may be attached or snap-fit onto the channel 35, as shown in FIG. 4. Preferably, the cap member 75 is formed from an extruded plastics material such as polyvinylchloride (PVC) and is similar in construction to the joint cover disclosed in U.S. Design Pat. No. 445,921. The extruded cap member 75 includes an outer wall 78 having slightly angled edge portions 79 and is integrally connected to parallel spaced ribs 82 each having laterally outwardly projecting inclined flexible fins 84. When the cap member 75 is pressed onto the channel member 35, the fins 84 frictionally engage the inner surfaces of the side walls 38 of the channel member to retain the cap member 75 where the edge portions 79 of the cap member flex and engage the outer edge surfaces of the channel side walls 38 and also the flush inside surface of the wall panel 22, as shown in FIG. 7.

Figure 6:
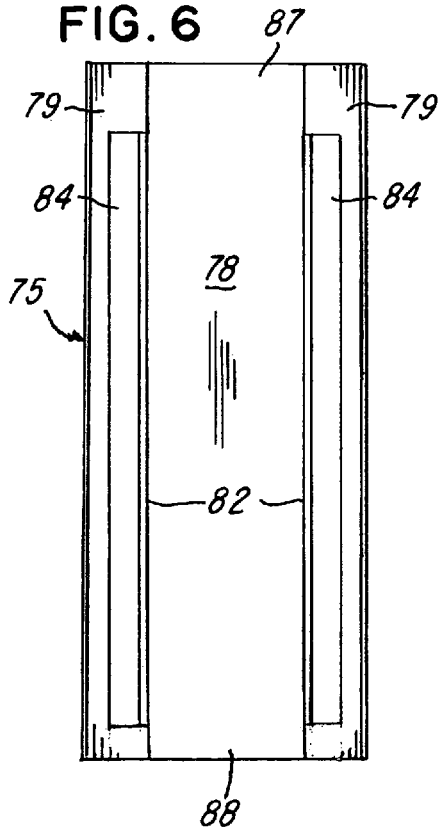
FIG. 6 is an elevational rear view of the cap member.

As shown in FIG. 6, upper portions of the ribs 82 are cut away from the extrusion to form an upwardly projecting flange 87 of uniform thickness and which engages the inner surface of the wall panel 22. At the bottom of the extruded cap member 75, the ribs 82 may be cut away to form a downwardly projecting flange 88 which covers the inner edge surface of the base plate 30. After the bolt 60 is tightened and the cap member 75 is reattached to the channel member 35, the outer surface of the cap member wall 78 is substantially flush with the inner surface of the concrete wall 22 and provides a decorative cover for the channel member 35.

From the drawings and the above description, it is apparent that a wall anchor system constructed and installed in accordance with the invention provides desirable features and advantages. More specifically, the anchor system provides for connecting or securing the concrete wall panel 22 to the concrete foundation 24 from inside the wall panel while the installer may be working on the concrete floor 26. The use of the bolt 62 with the concrete cutting threads 66 also eliminates the use of securing an anchor rod or bolt to the concrete with epoxy and the time required for the epoxy to cure. In addition, the small acute angle A between a vertical plane and the axis of the hole 60 and bolt 62 enables the bolt to withstand a substantially high tension force for securing the wall panel 22 to the foundation 24. The inclined position of the cavity defining member or channel 35 further helps to provide quick alignment reference for drilling the hole 60. The removable cap member 75 also prevents concrete from flowing into the cavity 40 during casting of the wall panel and, in addition, provides a decorative cover for the anchor 20 after installation of the self-tapping bolt 62. The position of the wall anchor 20 being flush with the inner surface of the wall panel 22 also eliminates the exposure of the wall anchor and the bolt 62 to exterior weather conditions in order to avoid corrosion of the anchor 20 and bolt 62.

While the method and form of anchor system herein described constitutes a preferred embodiment of the invention, it is to be understood that the invention is not limited to the precise method and form anchor system described, and that changes may be made therein without departing from the scope and spirit of the invention as defined in the appended claims.

What is claimed is:

1. An anchor system securing a vertical concrete wall panel to a supporting concrete foundation, said system comprising a substantially flat base plate embedded in said concrete wall panel adjacent a horizontal bottom surface of said wall panel, an elongated channel member having a lower end portion welded to the said base plate and projecting upwardly within said wall panel from said base plate at an acute angle less than twelve degrees from a vertical reference plane, said channel member having a generally U-shape horizontal cross-sectional configuration and including side walls defining a laterally open and upwardly extending elongated cavity within a vertical surface of said wall panel, a hole within said base plate at the bottom of said cavity, an elongated anchor bolt having a predetermined length and extending through said hole within said base plate and into an aligned hole within said concrete foundation, said hole within said foundation and said anchor bolt having an axis extending at said acute angle, and said elongated channel member and said laterally open elongated cavity extending upwardly within said wall panel by a distance substantially greater than said length of said anchor bolt to permit drilling said hole at said acute angle within said concrete foundation.

2. An anchor system as defined in claim 1 wherein said side walls of said elongated channel member have vertical edge surfaces substantially flush with said surface of said wall panel.

3. An anchor system as defined in claim 1 and including an elongated cap member having a portion projecting into said cavity and engaging said side walls, and said cap member includes longitudinally extending opposite edge portions projecting laterally outwardly and covering edge surfaces of said side walls and adjacent portions of said surface of said wall panel.

4. An anchor system as defined in claim 1 wherein said channel member comprises a longitudinally tapered member having generally triangular said side walls integrally connected by an inclined flat wall extending at said acute angle, and said side walls have vertical edge surfaces substantially flush with said surface of said wall panel.

5. An anchor system as defined in claim 1 wherein said base plate has a substantially uniform thickness, and said hole within said base plate has an axis inclined at said acute angle.

6. An anchor system as defined in claim 1 wherein said base plate is positioned at said acute angle relative to said bottom surface of said wall panel.

7. An anchor system as defined in claim 6 and including a concrete reinforcing bar having a lower end portion perpendicular to said base plate and an end surface welded to said base plate, and said bar has a substantially vertical upper portion within said concrete wall panel.

8. An anchor system as defined in claim 1 wherein said anchor bolt comprises a self-tapping concrete bolt having a shank portion with a sharp helical thread and an integral head portion pressing against said base plate.

9. An anchor system securing a vertical concrete wall panel to a supporting concrete foundation adjacent a concrete floor, said system comprising a substantially flat base plate embedded in said concrete wall panel adjacent a horizontal bottom surface of said wall panel, an elongated channel member having a lower end portion secured to the said base plate and projecting upwardly within said wall panel from said base plate at an acute angle less than twelve degrees from a vertical reference plane, said channel member having a generally U-shape horizontal cross-sectional configuration and including side walls defining a laterally open and upwardly extending elongated cavity within a vertical inner surface of said wall panel and above said floor, a hole within said base plate at the bottom of said cavity, an elongated anchor bolt having a predetermined length and extending through said hole within said base plate and into an aligned hole within said concrete foundation, said hole within said foundation and said anchor bolt having an axis extending at said acute angle, and said elongated channel member and said laterally open elongated cavity extending upwardly within said wall panel above said floor by a distance substantially greater than said length of said anchor bolt to permit drilling said hole at said acute angle within said concrete foundation.

10. An anchor system as defined in claim 9 wherein said side walls of said elongated channel member have vertical edge surfaces substantially flush with said inner surface of said wall panel.

11. An anchor system as defined in claim 9 and including an elongated cap member having a portion projecting into said cavity and engaging said side walls, and said cap member includes longitudinally extending opposite edge portions projecting laterally outwardly and covering edge surfaces of said side walls and adjacent portions of said inner surface of said wall panel.

12. An anchor system as defined in claim 9 wherein said channel member within said concrete wall panel comprises a longitudinally tapered member having generally triangular said side walls integrally connected by an inclined flat wall extending at said acute angle, and said side walls have vertical edge surfaces substantially flush with said inner surface of said wall panel.

13. An anchor system as defined in claim 9 wherein said base plate has a substantially uniform thickness, and said hole within said base plate has an axis inclined at said acute angle.

14. An anchor system as defined in claim 9 wherein said base plate is positioned at said acute angle relative to said bottom surface of said wall panel.

15. An anchor system as defined in claim 14 and including a concrete reinforcing bar having a lower end portion perpendicular to said base plate and an end surface welded to said base plate, and said bar has a substantially vertical upper portion within said concrete wall panel.

16. An anchor system as defined in claim 9 wherein said anchor bolt comprises a self-tapping concrete bolt having a shank portion with a sharp helical thread and an integral head portion pressing against said base plate.

* * * * *